US006217488B1

(12) United States Patent
Bernardson

(10) Patent No.: US 6,217,488 B1
(45) Date of Patent: Apr. 17, 2001

(54) LOWER EXTREMITY REHABILITATION AND TONING EXERCISE APPARATUS METHOD

(76) Inventor: Peter S. Bernardson, 11809 S. 45th St., Phoenix, AZ (US) 85044-2430

( * ) Notice: Subject to any disclaimer, the term of this patent is extended or adjusted under 35 U.S.C. 154(b) by 0 days.

(21) Appl. No.: 09/218,184

(22) Filed: Dec. 22, 1998

Related U.S. Application Data

(63) Continuation-in-part of application No. 08/509,206, filed on Jul. 31, 1995, now Pat. No. 5,851,166.

(51) Int. Cl.[7] ..... A63B 23/04
(52) U.S. Cl. ..... 482/79
(58) Field of Search ..... 482/51, 52, 53, 482/79, 80, 121

(56) References Cited

U.S. PATENT DOCUMENTS 3,741,540 * 6/1973 Shimizu ..... 482/79
5,277,677 * 1/1994 Terauds ..... 482/53
5,851,166 * 12/1998 Bernardson ..... 482/79

* cited by examiner

*Primary Examiner*—Stephen R. Crow
(74) *Attorney, Agent, or Firm*—Duane, Morris & Hechscker, LLP

(57) ABSTRACT

A rocking-type foot and lower leg exercising apparatus incorporates one or two centrally pivoted pedals mounted upon a base in a position facilitating the placement of the feet of the user upon such pedal or pedals while seated in a chair and rocking of the pedals with the foot positioned upon them to provide a soothing motion that will maintain the tone of the muscles of the legs and encourages blood circulation in the feet and legs. The pivot point of the pedal or pedals may be located at any vertical position between the base and the pedal, but is located longitudinally, between about one fourth to one half of the distance from the end of the pedal or pedals. A motor, solenoid, actuator, or other electrical hydraulic or pneumatic means or any combination thereof may be provided to generate rocking-type motion of the pedals.

2 Claims, 13 Drawing Sheets

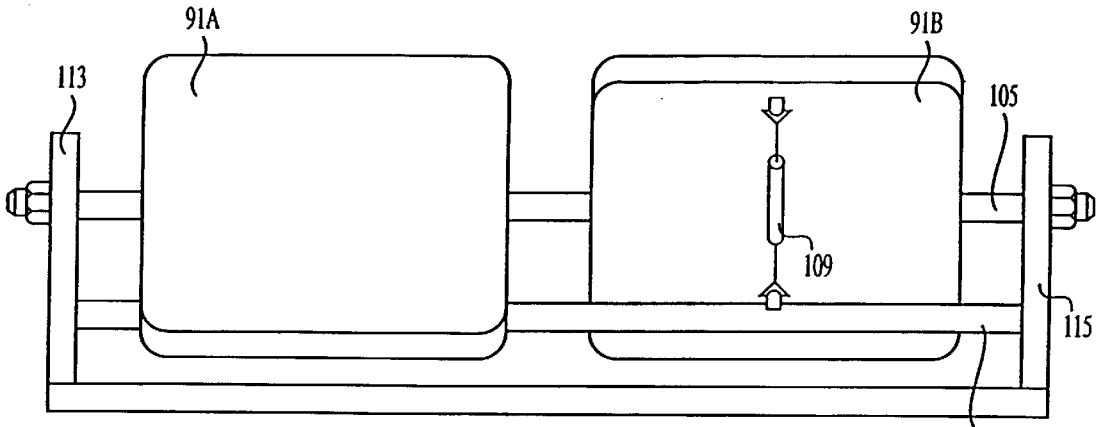
FIG. 18
FIG. 19
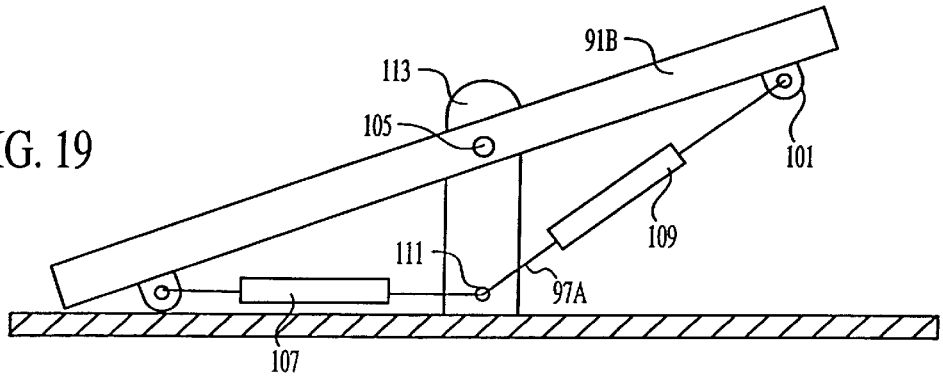
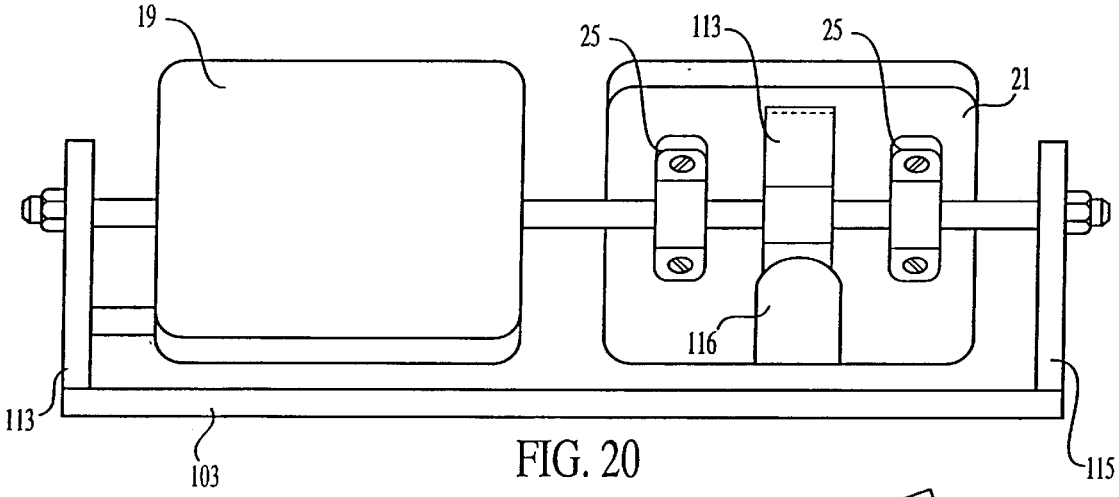
FIG. 20
FIG. 21
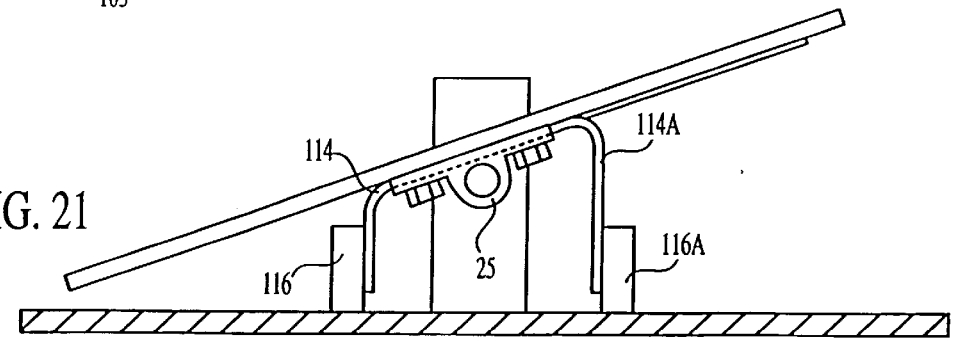

LOWER EXTREMITY REHABILITATION AND TONING EXERCISE APPARATUS METHOD

CROSS REFERENCE TO RELATED APPLICATIONS

This application is a continuation-in-part of application Ser. No. 08/509,206, filed Jul. 31, 1995, U.S. Pat. No. 5,851,166 and incorporates the subject matter of Disclosure Document No. U.S. PTO-jc586 filed Apr. 5, 1998 in the Patent and Trademark Office.

BACKGROUND OF THE INVENTION

1. Field of the Invention

This invention relates to physical conditioning and medical rehabilitation, general exercise and the toning of the lower extremities of the body. More particularly the invention provides an apparatus and method for maintaining circulation and muscle tone in the feet and lower legs of individuals, which is useful while they are seated or confined to a chair.

2. Prior Art

Vigorous athletes, such as runners and the like, frequently injure their lower legs and/or feet necessitating relatively severe restriction of movement during healing. For example, runners are frequently subject to hairline stress fractures of the bones of the lower leg, also known as "shin splints". Cramps of the calf muscles are also quite common among runners. These types of injuries can often pull or tear muscle tissue, requiring long term enforced inactivity to allow healing to occur. During such enforced inactivity, much of which may be passed resting or reclining in a chair, athletes who are normally quite physically active become uncomfortable or even nervous from lack of exercise. Enforced inactivity also tends to delay healing of the injured muscle tissue. Often, the enforced inactivity will require the injured athlete to spend an inordinate amount of time reclining or sitting in a chair, even while undertaking other activities. While sitting, circulation is often seriously decreased to the lower extremities (legs, ankles, feet, etc.) tending to induce additional injury. These same problems are often encountered by non-athletes, and can be particularly troublesome for older persons, whose level of physical activity may already be diminished and whose physical health may be declining with age.

Physical inactivity often causes the muscular tissue of the heart to lose tone and become weaker. This loss of heart muscle may take place at the same time as extra strain is placed on the heart due to illness or age. Such extra strain can also be due to lack of movement of the muscles. Movement of the muscles of the lower extremities in particular, where many of the major muscles and blood vessels of the body are located, serves normally to significantly aid in pumping blood through the body due, in part, to kneading, or continuing variable pressure, of the moving muscles against adjacent blood vessels. It is frequently estimated that in active walking or running, a significant percentage of the actual pumping of blood in the body, up to as much as twenty to twenty-five percent or more, is due to the pumping effects of blood moving through the vessels of the legs under the impetus of muscles squeezing against blood vessels. Thus, a certain amount of movement of the lower extremities can be very important in maintaining health even in fairly vigorous persons. Consequently, there is a need for a practical exercise apparatus to enable movement in the lower extremities to be continued, at least on a reduced scale, by those persons subjected to long periods of inactivity, particularly in a seated position.

In recent years there have been numerous attempts to provide ergonomically designed office machines and office furniture for improving circulation. These efforts have been directed more toward developing office machines that are less tiring to operate, than providing ways to actually relax the body and maintain circulation by mild exercise. A number of large and small scale exercise machines are known for exercising the legs, such as treadmills, bicycling machines and so-called stepping machines. These and other known exercise apparatus often rely upon a stepping or placing of the weight alternately upon first one leg and then the other while in a standing position, or, at a minimum, while being in a cycling position such as in the use of a stationary bicycle. These types of known exercise machines are normally not devised for use by persons who are seated in a conventional chair, e.g., a desk chair or easy chair. Some examples of known, small scale exercise machines are set forth below.

U.S. Pat. No. 5,256,118—Chen discloses a small scale so-called "stepper" device car pedal exerciser in which two adjacent pedals are pivoted at one end and act against a pair of air bellows between the pedals and a base. The bellows allow the pedals to rise and fall resiliently as the user transfers his or her weight alternatively from one to the other pedal. The device does not appear to be suitable for operation or use from a sitting position.

U.S. Pat. No. 5,267,923—Piaget et al. discloses a stepper-type exercise machine involving the use of bellows at the opposite end of pedals in a small scale, easily portable and storable exercise machine. While the arrangement of the pedals of the Piaget machine is such that it could possibly be used from a seated position, such use would be quite awkward unless the seating was in a position similar to that assumed on a bicycle.

U.S. Pat. No. 5,290,204—Lee discloses a small and compact pedaling machine in which the pedals are pivoted at one end and movement is resisted by a fluid cylinder means of a suitable type and including a coordinating arm to allow only one pedal to be depressed at a time.

U.S. Pat. No. 5,304,105—Hsieh discloses a small scale stepping-type exerciser in which the pedals are pivoted at one end, and are rendered resiliently movable by the use of interconnected inflatable balls positioned under the pedals. As with Piaget et al., the Hsieh device may possibly be used, with some difficulty, from a seated position, but it is not conveniently designed for such use.

U.S. Pat. No. 5,299,995—Ko discloses a relatively small scale foot or leg exercising device in which a pair of conventionally pivoted bicycle pedals are mounted on flexible members that provide for a reciprocable movement in an adjustably pivoting tower arrangement which allows the user to, in effect, obtain a bicycling exercise motion from a seated position. The essential movement of the pedals is up and down on the apparatus.

There is a need for a small, easily portable and readily usable apparatus for mildly exercising the lower extremities, and particularly the feet and calves, from a sitting position such as is customarily assumed when watching television, operating a computer, traveling in a car or plane which will keep the legs and feet moving, but will not injure already injured muscles or ligaments. There is also a need for a method for use of this and similar apparatus to exercise the lower extremities.

SUMMARY OF THE INVENTION

It is therefore an object of the present invention to provide an apparatus in which a foot support or pedal pivots from a central or near central area of the support so that the support is conveniently and easily operated with a rocking motion from a conventional seated position.

It is a further object of the invention to provide an exercise apparatus that provides a gentle rocking motion to the feet from a seated position causing movement in the muscles of the lower extremities without excessive movement tending to distract the exerciser or overextend injured tissues.

It is a still further object of the invention to provide a mild exercise and movement of the feet of the user that will be effective to relieve tension in the lower portion of the lower extremities and keep the blood circulating in the tissues involved.

It is a still further object of the invention to provide a rocking motion foot exerciser that can be used from a seated position to move and mildly exercise the feet either with or without resilient resistance to such rocking motion.

It is another object of the invention to provide a rocking-type foot exerciser that can be used from a seated position in which the rocking motion can be inactivated and the apparatus used as a simple foot rest.

It is a further object of the invention to provide a rocking-type foot exerciser having two centrally pivoted pedals which can operate independently or coordinated so that the pedals act as a single pedal coordinated to rock in alternating fashion or alternatively together in unison.

It is a still further object of the invention to provide a rocking-type foot exerciser in which a motor, solenoid, actuator or similar means is provided to generate the rocking motion of a centrally pivoted pedal.

These and other objects are accomplished in the lower extremity exercising device according to the invention. The lower extremity exercising device has a base upon which is preferably mounted a single pedal having sufficient width to accommodate a pair of feet. The pedal is pivotally connected at a centrally located portion thereof to the base to allow a rocking-type movement of the pedal about a transverse pivotal axis. A motor, solenoid, actuator or other electrical, hydraulic or pneumatic means or any combination thereof may be used for generating the rocking-type pedal movement.

BRIEF DESCRIPTION OF THE DRAWINGS

FIG. 18 is an end view of a still further alternative embodiment of the invention.

FIG. 19 is a partially broken-away, side elevation, of the embodiment shown in FIG. 18.

FIG. 20 is an end view of a still further embodiment of the invention with an alternative arrangement for providing resilience to the pedals.

FIG. 21 is a partially broken-away, side elevation, of the embodiment of FIG. 20.

DETAILED DESCRIPTION OF THE PREFERRED EMBODIMENTS

Active persons or even relatively inactive persons, may be injured so that they cannot safely continue to effectively exercise their lower legs, in particular their feet and calves. Cessation of exercise causes loss of tone and strength in the muscles and ligaments involved. Continued exercise would be very beneficial both to maintain conditioning and promote healing by encouraging blood supply to the affected parts. In these cases, it may not be desirable to provide really vigorous exercise. Yet, mild exercise is desirable to prevent a general stasis of the blood, as well as to soothe the patient and make him more comfortable. In addition, persons having a relatively sedentary work environment, including computer programmers, word processor operators and the like, often have difficulty in keeping adequate circulation in their lower limbs. Travelers in cars and airplanes also are exposed to long periods of sitting in relatively restricted positions that interfere with adequate circulation.

It has been found by the inventor that mild and soothing exercise can be attained by the use of a novel rocking exercise apparatus for the feet which allows the user to be comfortably seated in a chair or the like while they rock their feet upon rocking pedals on a portable exercise device, thus encouraging circulation in the lower legs and feet and soothing the user. By periodically rocking the feet from front to back or vice versa, from time to time or continuously over a period of time, the user keeps the feet from becoming stiff and maintains a range of movement in the ankles. In addition, and very importantly, the user maintains a continuous or periodic kneading or massaging of the muscles, particularly of the calves, as well as the muscles toward the front of the lower legs upon maintaining circulation and combatting stasis or pooling of the blood in the tissues. Maintenance of circulation plus periodic movement not only increases physical fitness and health, but also has a desirable cosmetic effect of maintaining shapely calves. Periodic movement also contributes to comfort and general well being of the user.

Figure 1:
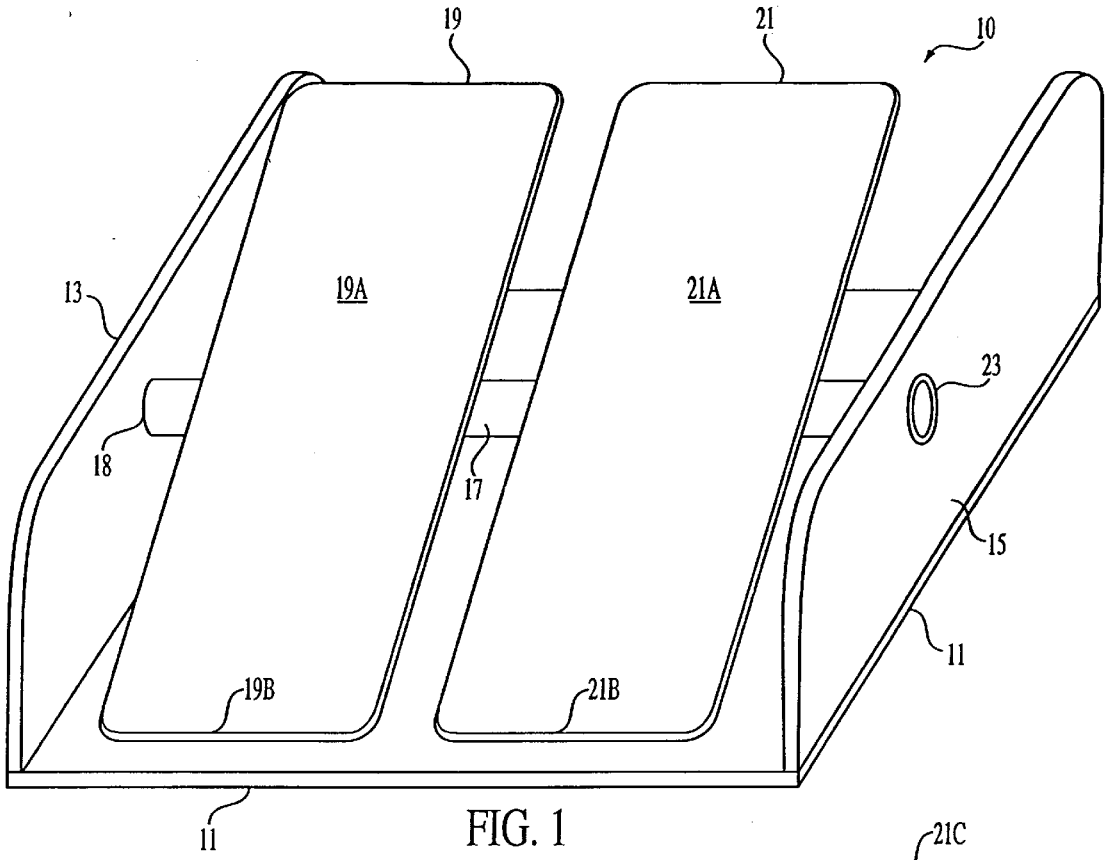
FIG. 1 is an isometric view of a basic embodiment of the invention.

FIG. 1 is an isometric view of a basic embodiment of the exercise device of the invention in which reference numeral 10 indicates the device broadly. Exercise device 10 is comprised of a base 11 that is adapted for placement on the floor of a room or other surface upon which one may place their feet. There are provided upon base 11 a left side wall 13 and a right side wall 15 that are secured to base 11 in any suitable manner. For example, side walls 13 and 15 may be integral continuations of base 11. Attached to, or extending through side walls 13 and 15 is a pivot rod 17, which, as shown, passes through orifices or openings 18. Fasteners 23 are disposed on the ends of pivot rod 17 so as to maintain pivot rod 17 in position within openings 18 of side walls 13 and 15. Pivot rod 17 supports pedals 19 and 21 upon which the feet of the user are placed during use of exercise device 10. Left pedal 19 and right pedal 21 are journaled upon pivot rod 17, and secured by pivot rod fittings 25, as shown more particularly in FIGS. 2 and 3. Pivot rod fittings 25 are secured to pedals 19 and 21 via fasteners 27. It should be understood that pedals 19 and 20 are loosely journaled on pivot rod 17 so that the two pedals may be independently rocked upon pivot rod 17.

Figure 2:
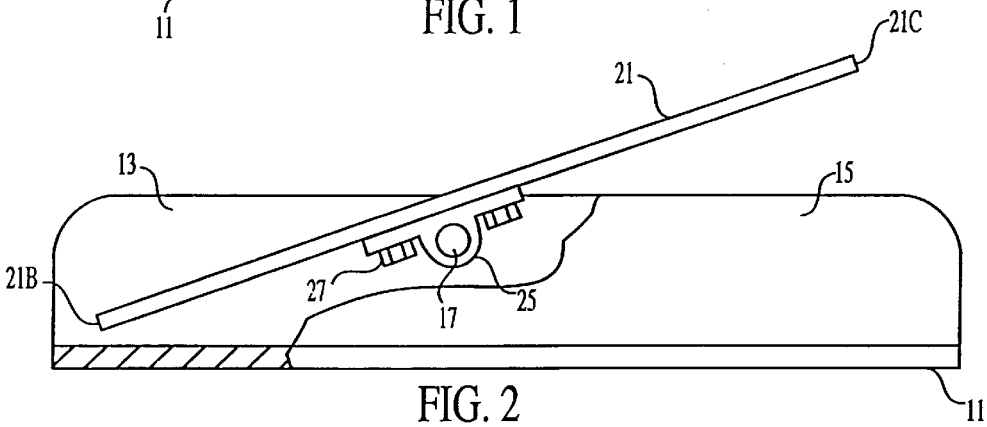
FIG. 2 is a side elevation, partially broken-away, of the embodiment of the invention shown in FIG. 1.
Figure 2A:
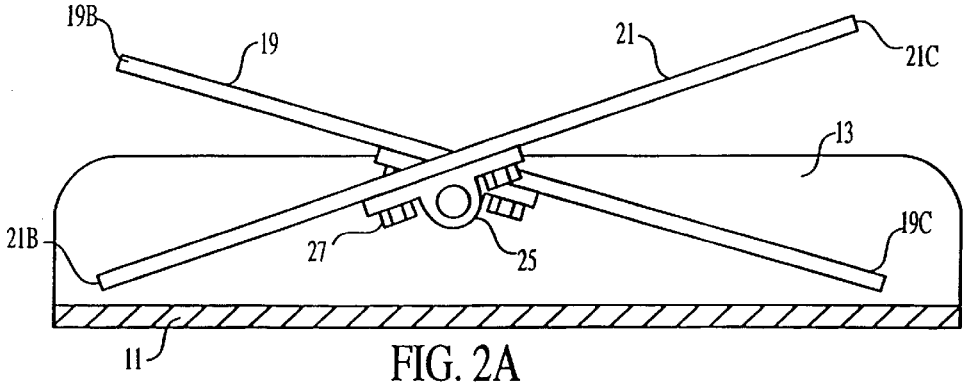
FIG. 2A is a partially broken-away side elevation, similar to FIG. 2, except that two pedals are shown inclined oppositely.
Figure 3:
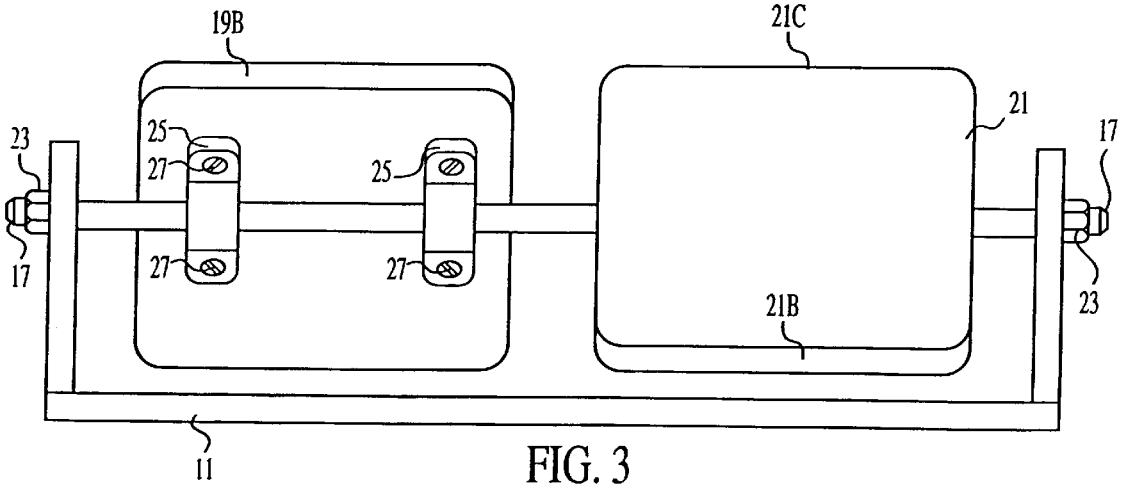
FIG. 3 is an end elevation of the embodiment of the invention shown in FIGS. 1 and 2, with the pedals inclined oppositely as shown in FIG. 2A.

FIG. 2 is a partially broken-away diagrammatic side elevation of the exercise device shown in FIG. 1 with the side wall 15 partially broken-away to show, in particular, pivot rod fitting 25 and fitting fasteners 27 which together secure pedal 19 and pedal 21 to the pivot rod 17. FIG. 2A is a diagrammatic view of the arrangements shown in FIGS. 1 and 2, but in which an additional portion of the side wall 15 has been partially cut away and the pedal 19*a* is turned downwardly with its farther end near the base 11, while the pedal 21 remains in the same position as shown in FIG. 2 with the rear or nearest end of the pedal near to the user and rocked downwardly so as to be adjacent to the base 11. FIG. 3 is an end elevation of FIG. 2A showing the pedals 19 and 21 positioned in the same arrangement as in FIG. 2A. The pivot rod fittings 25 and their fitting fastenings 27 are also clearly visible on the lower side of the pedal 19 in FIG. 3.

Pedals 19 and 21 constitute convenient foot contact and support means upon which the left and right feet of the user may be placed so that either the sole of the user's foot or the sole of any footwear which the user happens to be wearing are substantially completely supported against the support surface of the contact and support means or members. The heel of a user's foot is placed upon the "near" end (relative to the user) of the upper surface 19A, 21A of each pedal 19 and 21, and the toe of the user's foot is placed upon the "far" end (relative to the user) of upper surfaces 19A, 21A of each pedal so that each of the user's feet are disposed in a comfortable position against the upper surface of each pedal. Depending upon the height of pivot rod 17 above base 11, and the length of pedals 19 and 21, the normal resting position of the feet of the user upon the upper surfaces 19A and 21A will be either with the lower ends 19B and 21B of pedals 19 and 21 contacting the upper surface of base 11 or with lower ends 19B and 211B of pedals 19 and 21 held a certain distance above the upper surface of the base 11. It will be understood that if the lower ends 19B and 21B of pedals 19 and 21 are maintained above the upper surface of the base 11 when the feet of the user are securely placed upon upper surfaces 19A and 21A, an opportunity for the user to rock their toes upwardly or forwardly, and their heels downwardly, is provided so as to desirably flex the ankles of the user and to stretch the calf muscles.

Referring to FIGS. 1, 2 and 2A, the pivot point or position of pivot rod 17, with respect to the base 11, is displaced somewhat toward the near or rear portion of exercise device 10 to create a steep angle of pedals 19 and 21, relative to base 11, when the foot of the user is rocked rearwardly. This arrangement allows the users foot to be pivoted about the ankle joint, toward the shin bone to a position where the angle between the user's foot and the user's shin is less than or equal to ninety degrees. The user's foot may then be rocked forwardly to a substantially extended position. Exercise device 10 is normally placed on the ground at a comfortable distance from the user so that the user may place its foot lightly upon pedals 19 and 21. Exercise device 10 has a height which will tend to lift the outer end of the leg of the user higher than it might normally be when placed directly upon the ground surface.

Figure 2B:
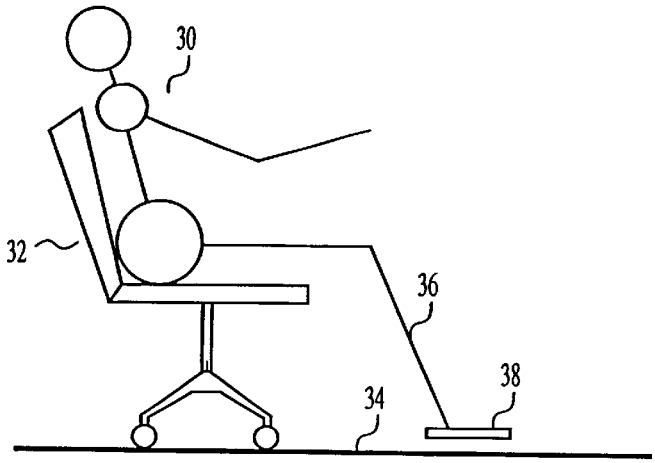
FIGS. 2B and 2C are diagrammatic figures illustrating the exercise movement attained with the invention.
Figure 2C:
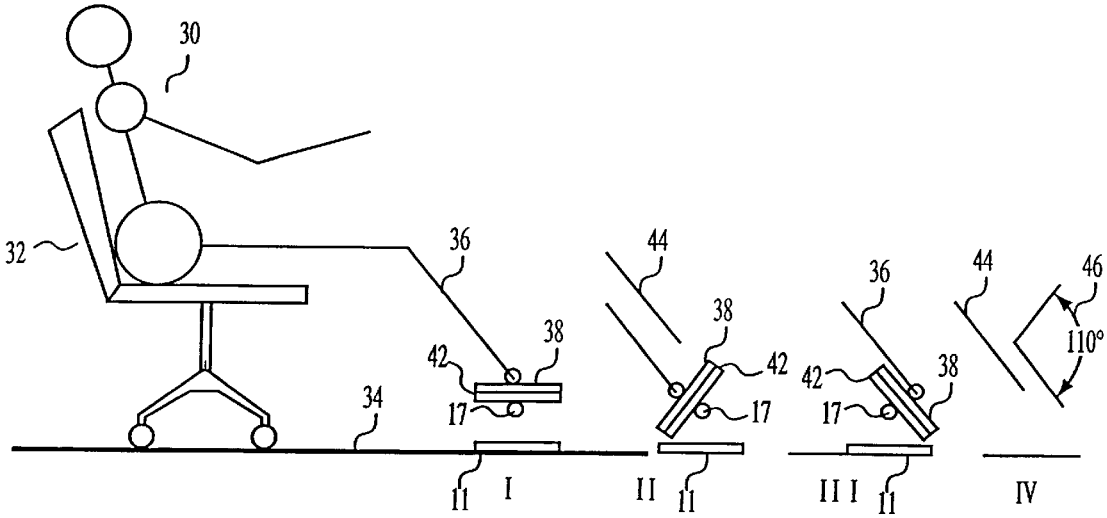

In the preferred embodiment of the invention, pedals 19 and 21 are freely rotatable on pivot rod 17, so that exercise device 10 will normally be pushed, by the user, out to a position farther away from the user than his foot would normally be placed without the exercise apparatus. This will automatically tend to extend the entire leg of the user so that the foot is normally in a position somewhat extended, with respect to the leg, as if the foot were being placed upon a foot rest or hassock in front of the user. In this position, the foot is already extended in its normal position upon the pedals 19 and 21, so that the major movement available is to the rear, tending to pivot the rear surface or rear end 21*b* of pedals 19 and 21 downwardly toward base 11. When the user's foot is extended forwardly, to its maximum extension, it will tend to rotate less. In fact, if the device is pushed out to a point where the leg of the user is more or less completely extended, the relative rotation of the foot of the user will be much less toward the front and will tend to bring the foot almost parallel to the upper surface of base 11, rather than be rotated downwardly against base 11. Rearward rocking of the foot will tend to bring each pedal 19, 21 to an angle that is greater than perpendicular, as measured from an axis directed longitudinally along an extended leg. This relationship is shown in FIGS. 2B and 2C. FIG. 2B shows, diagrammatically, the normal leg and foot position of a human body 30 seated in a chair, such as, an office chair 32. The feet of the user are placed upon the ground 34 upon which the chair 32 also rests. FIG. 2C shows, diagrammatically, the same position of human body 30 with feet 38 placed on pedals 19 and 21 of exercise device 10. The exercise range of the foot is normally from about parallel with the extended leg of the user to about 10 to 25 degrees beyond a point perpendicular to a line that is parallel to the lower leg of the user.

More particularly, and referring to FIG. 2B, the lower leg 36 of human body 30 extends downwardly to foot 38 which is disposed in parallel relation to ground 34. This is the normal position of a person sitting in a typical chair 32. FIG. 2C diagrammatically shows human body 30 seated in chair 32 with foot 38 placed upon the upper surface of pedal 42 of an exercise device 10, such as is shown in FIGS. 1 through 3. Base 11 of exercise device 10 is shown placed upon ground 34. Since exercise device 10 has a certain height above ground 34, it will be seen that lower leg 36 of human body 30 will normally be positioned at a more acute angle with respect to ground 34, and foot 38 will be more nearly parallel to ground 34. See views I of I–IV of FIG. 2C. This is actually a more relaxed position, since it more closely approaches the position which the leg and foot would assume if they were being supported upon a conventional footrest or hassock.

To exercise the muscles in the foot and the calf as well as other muscles in the lower leg, foot 38 is rocked rearwardly to an angle as shown in view II of FIG. 2C. Here, foot 38 and pedal 42 are rocked backwardly or rearwardly, i.e., toward human body 30, until foot 38 is slightly more than perpendicular to a line 44 drawn parallel to the longitudinal axis of leg 36 or, approximately 10 to 25 degrees upwardly from, or beyond perpendicular to, the longitudinal axis of leg 36. In view III of FIG. 2C, foot 38 is shown rocked forwardly or downwardly to the front, i.e., away from human body 30, until the angle of pedal 42 and foot 38 are nearly parallel to line 44. In other words, foot 38 is essentially parallel to the longitudinal axis of the lower portion of leg 36. The angle between the maximum rocked backward position of foot 38 on pedal 42 is, as shown diagrammatically in view IV of FIG. 2C, essentially the angle 46 which, if measured, would be found to be approximately 110 to 115 degrees for the average person, or in exceptional persons, up to 125 degrees.

The length of foot contact and pedals of the exercise device 10 should preferably not be much greater than the length of the foot of the person using the apparatus. In this way the range of movement or pivoting of the pedal is not limited any more than is necessary. However, as a practical matter, the length of the foot contact and support means will be made to be approximately as long as the foot of the largest average dimensioned person who is likely to use the device. Pedals for men or women may be supplied, and each pedal includes a heel and ball of the foot contact portions, which in some cases will actually be delineated upon the pedal.

Figure 4:
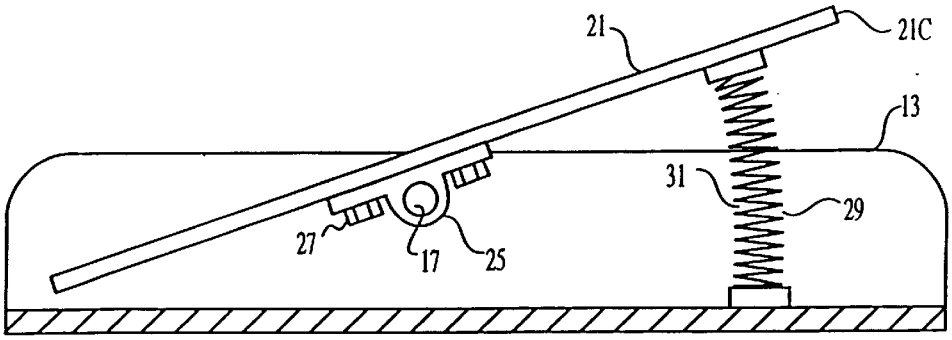
FIG. 4 is a side elevation of an alternate embodiment of the invention in which the rocking pedals are provided with a resilient means positioned at the far end of the pedal to provide additional resistance to movement of the pedal, the resistance being, in the instance shown, provided by a coil spring-type resistance.

Referring now to FIG. 4, a resistance means (broadly designated by reference numeral 29) is shown positioned on the far end of pedal 21. Resistance means 29 may comprise a coil spring type resistance having a series of interconnected coils 31 which, when pressed together, towards each other, allow far end 21*c* of pedal 21 to be forced downwardly toward base 11 and in that manner provides resistance against the movement of foot 38 of the user. In this way additional exercise, particularly to the calf muscles, is provided by rotating the foot downwardly against the resistance of coils 31 of the resistance 29.

Figure 5:
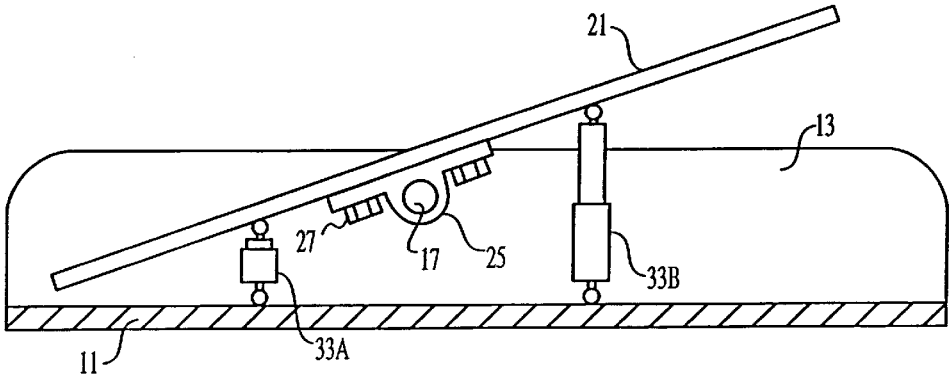
FIG. 5 is a side elevation of a still further embodiment of the invention in which the pedals are provided at both ends with additional resistance to movement of the pedal, in this instance fluid cylinder-type resistance.

Referring now to FIG. 5, in an alternative embodiment of the present invention, two resistance means 33*a* and 33*b* may be positioned in contact with the lower side of the pedal 21 and the upper surface of base 11. In this position, resistance 33*a*, which is shown in the form of a fluid pressure cylinder, will resist rocking of pedal 21 downwardly toward the rear or near end of exercise device 10, while pressure cylinder 33*b* will resist movement of the opposite end of pedal 21 toward the base 11. The two resistance means 33*a* and 33*b* act together to provide resistance to the movement of the pedal at all times. Such fluid resistance cylinders may be either single acting or double acting and are shown diagrammatically merely to illustrate that various resistance means or resilient resistance means may be used to resist movement of the pedals and therefore provide additional resistance against movement of the muscles of the user's body to provide additional exercise.

Figure 6:
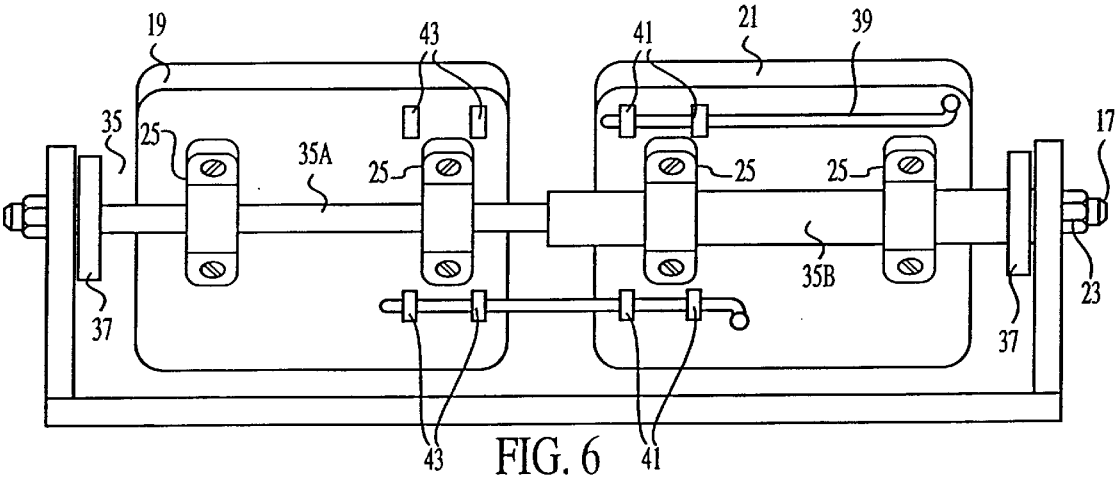
FIG. 6 is an end elevation of an embodiment of the invention in which the two pedals are provided with separate flat coil spring means to resist rocking and the pedals may, if desired, be secured together to provide coordinated movement.

Referring to FIG. 6, there is shown an end view of a diagrammatic representation of an exercise apparatus in accordance with the invention in which pedals 19 and 21 are journaled on separate concentric sections of a single pivot rod mounting 35. Pivot rod 35 is formed from an inner pivot rod 35A, upon which the pedal 19 is secured, and an outer pivot rod 35B to which pedal 21 is attached. In this case, the two pivot rod sections 35A and 35B are journaled in side walls 13 and 15 so that pivot rod 35 rotates as a unit when pedals 19 and 21 are rotated in unison, and the two sections 35A and 35B when operated independently rotate independently with respect to each other. Pedals 19 and 21 are attached rigidly to the two pivot rod sections 35A and 35B so that the entire assembly, including the pedal and the portion of pivot rod upon which it is mounted, rotate or rock back and forth as a unit. Pivot rod 35 may be journaled in end walls 13 and 15 in any suitable bearing arrangement, e.g., a lubricated orifice or bearings or roller bearings or other suitable bearing arrangement, not shown. At the ends of the two concentric pivot rod sections 35*a* and 35*b*, there are shown coil spring assemblies 37 which are attached to the pivot rods 35*a* or 35*b* and to the adjacent side walls 13 or 15. In this way, when pivot rod sections 35*a* or 35*b* rotate, the spring elements 37 will be either tightened or loosened, depending on the particular rotation of pivot rod sections 35*a* or 35*b*. As a result, the rotation of the pivot rod sections is resisted and through such resistance, the resistance of foot pedals 19 and 21 to movement of the feet of the user is provided. The embodiments shown in FIGS. 6 and 6A provide a convenient and efficient arrangement for securing independent resistance against rocking or rotational movement of the two pedals, independently, to provide additional exercise to the lower portions of the legs and the feet of the user.

Figure 6A:
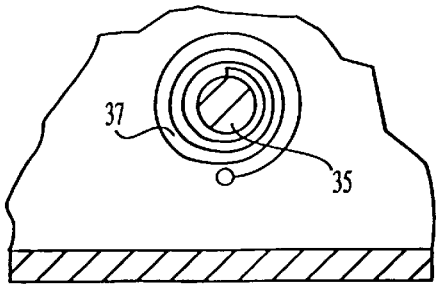
FIG. 6A is a partial side view of one of the flat coil spring arrangements arranged about the axle of the pedals to provide resistance against rocking.

There is also shown in FIGS. 6 and 6A, two latching means for securing the two independently-acting foot pedals together in case it is desired to operate in a single foot pedal mode. In this case, a single foot pedal acts in unison with respect to the two feet of the user and, the user obtains twice the resistance to movement of the two pedals as would be obtained with one pedal. More particularly, straight securing means, or pins 39, are shown mounted on the lower portions of pedals 19 and 21 in loops or pin fittings 41 in which pins 39 slide and align with similar loops or pin fittings 43 on the underside of the adjacent pedal, in this case pedal 19. The end of pins 39 are slid to lock pedals 19 and 21 together for coordinated movement rather than independent movement. As viewed in FIG. 6, upper pin 39 on the nearer portion of the pedal 21 is shown retracted from the loops 43 so that this portion of the pedals 19 and 21 are not secured together, while lower pin 39 is shown pushed through loops 41 and 43 on both pedals 19 and 21 so that the farther or outward portions of the pedals 19 and 21 are temporarily locked together. It will be understood that the foregoing arrangement for locking the two pedals together is merely a simple illustrative arrangement. There are, of course, many other means of interlocking the pedals.

Figure 7:
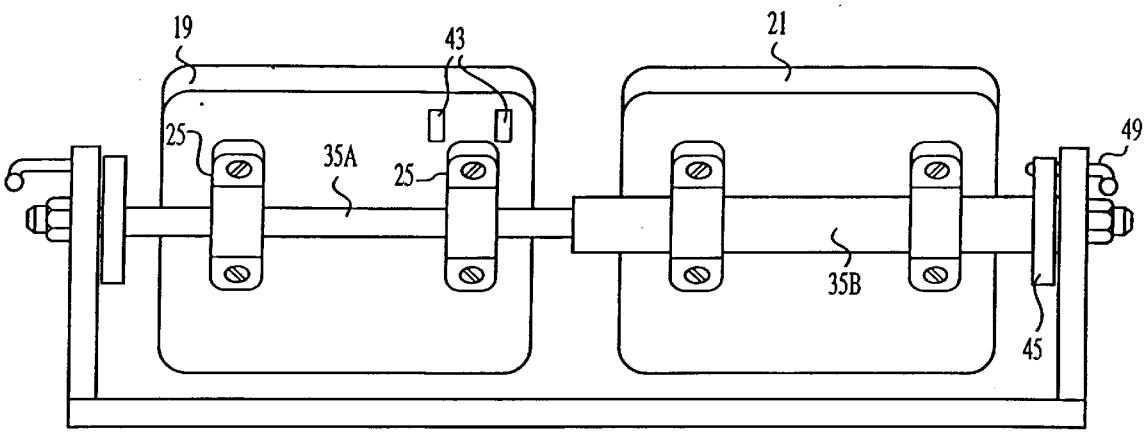
FIGS. 7 and 7A are an end view and a partial axle view of an embodiment of the invention constructed to provide or allow the rocking pedal exercise machine to be used as a simple footrest upon the election of the user.
Figure 7A:
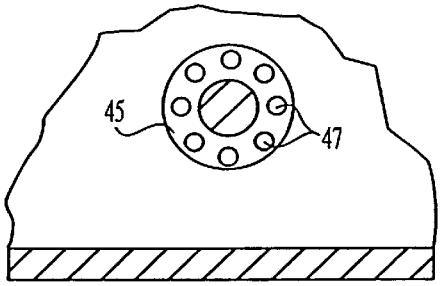

Referring to FIGS. 7 and 7A a somewhat similar arrangement of pedals 19 and 21 upon concentric pivot rods 35*a* and 35*b* includes a spring resistance arrangement at the two ends, which have attached thereto concentric pivot rods to which pedals 19 and 21 are permanently secured to independent locking members 45A. Locking member 45A may be welded or soldered to the pivot rods so that locking members 45 are, in effect, integral with pivot rods 35*a* and 35*b*. Locking members 45 have a series of locking orifices 47 which extend through the locking members and provide openings for receiving locking pins 49, which may extend through orifices (not shown) in side walls 13 and 15 at both sides of pivot rods 35*a* and 35*b*. Locking pins 49 act to immobilize locking members 45 by extending through the locking orifices 47. Since pedals 19 and 21 are secured directly to pivot rods 35*a* and 35*b* in this embodiment, pivot rods 35*a* and 35*b* may be effectively immobilized in any position desired by the user to form a foot rest.

Figure 8:
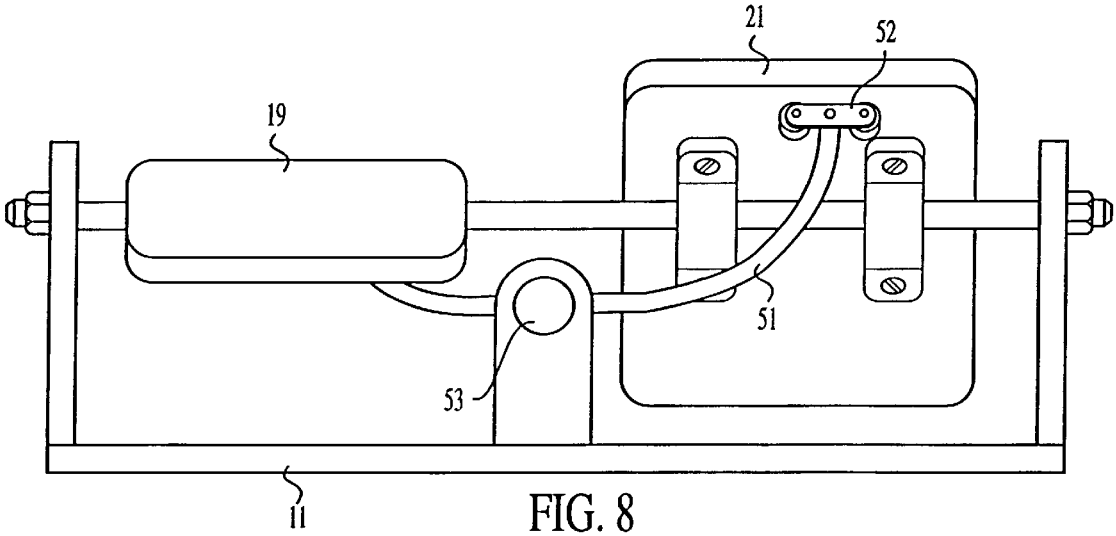
FIG. 8 is an end elevation of an embodiment of the invention in which the two pedals are coordinated together by a lever-type connection so that they rock alternatively, one pedal being depressed as the other pedal rises.

Referring to FIG. 8, a coordinating arm 51 is shown pivoted at 53 and extending into contact with the lower portion of each pedal 19 and 21. A pair of rollers 52 are journaled on the ends of arm 51 to allow the ends to move easily in contact with the bottom of each pedal 19, 21. It will be understood that when pedal 19 is pushed downwardly (as is shown for the nearer portion in FIG. 8) the coordinating arm 51 will be raised on the right side under pedal 21 and will cause a portion of pedal 21 to pivotally rise while another portion of pedal 21 will be pressed downwardly. In this way, the movement of the two pedals is coordinated in a very simple mechanical manner so that one will necessarily rock in one direction while the other is rocking in a second direction. This may be convenient to some users who lack coordination in movements of their feet. However, it also enables the user to place varying degrees of pressure upon one pedal that is dependent on the resistance placed on the other pedal. This arrangement sets up a form of dynamic tension in which one portion of the body is arranged to act against another portion of the body so that the body of the user is providing the tension or pressure on the exercise device to exercise different parts of the body. These dynamic tension arrangements are often a simple way to provide additional tension in an exercise arrangement.

Figure 9:
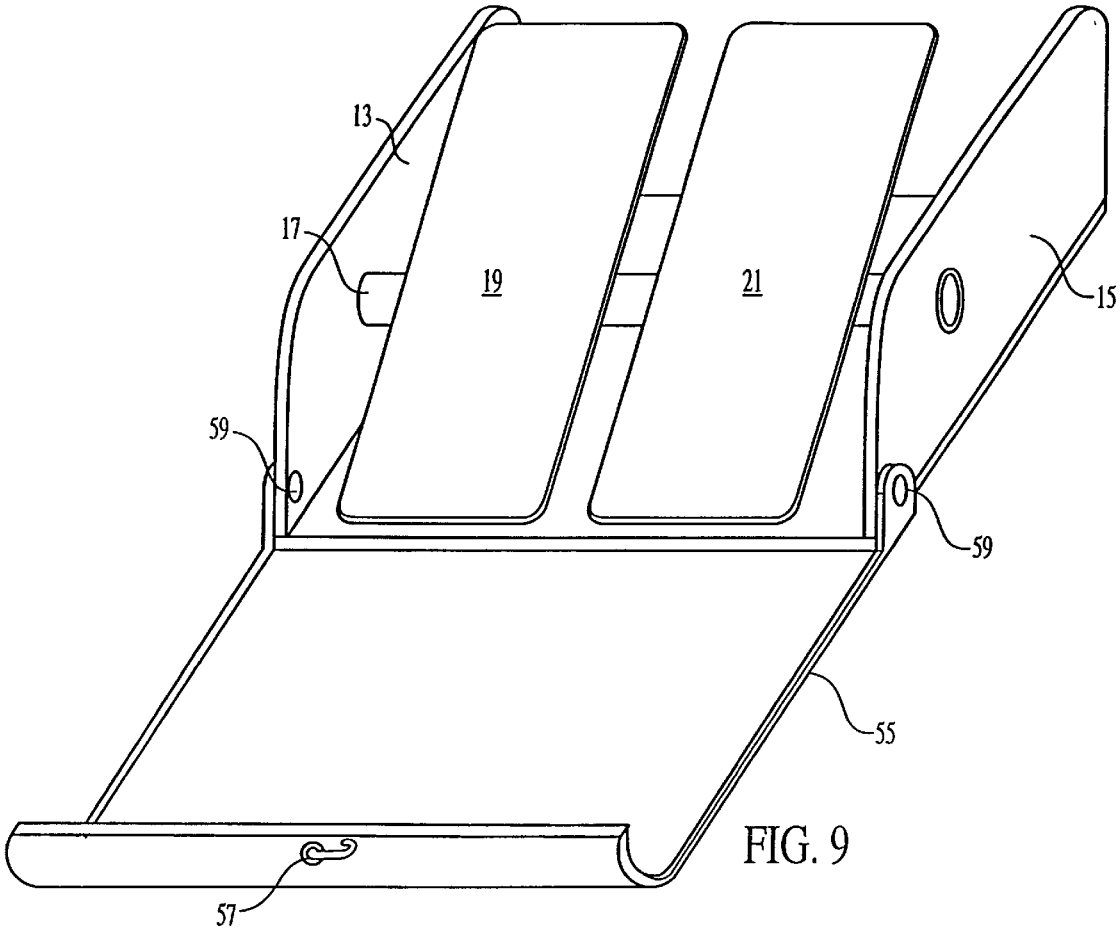
FIG. 9 is an isometric view of a portable version of the invention in which a cover is provided that may be folded or pivoted upwardly to enclose the apparatus for carrying on an airplane or train.

Referring to FIG. 9, the entire exercise device 10 is provided with a cover 55. Cover 55 may be swung up to enclose the apparatus when not in use to make it portable. For example, with this embodiment it is possible to exercise the legs while riding in an automobile, bus, or airplane during long trips when circulation in the legs may become stagnant. A latch 57 is provided to interact with another latch, not shown, at the opposite end of the apparatus to hold the cover 55 over the apparatus during transportation. Pivot pins 59 are provided for pivotally attaching cover 55 to side walls 13 and 15.

Figure 10:
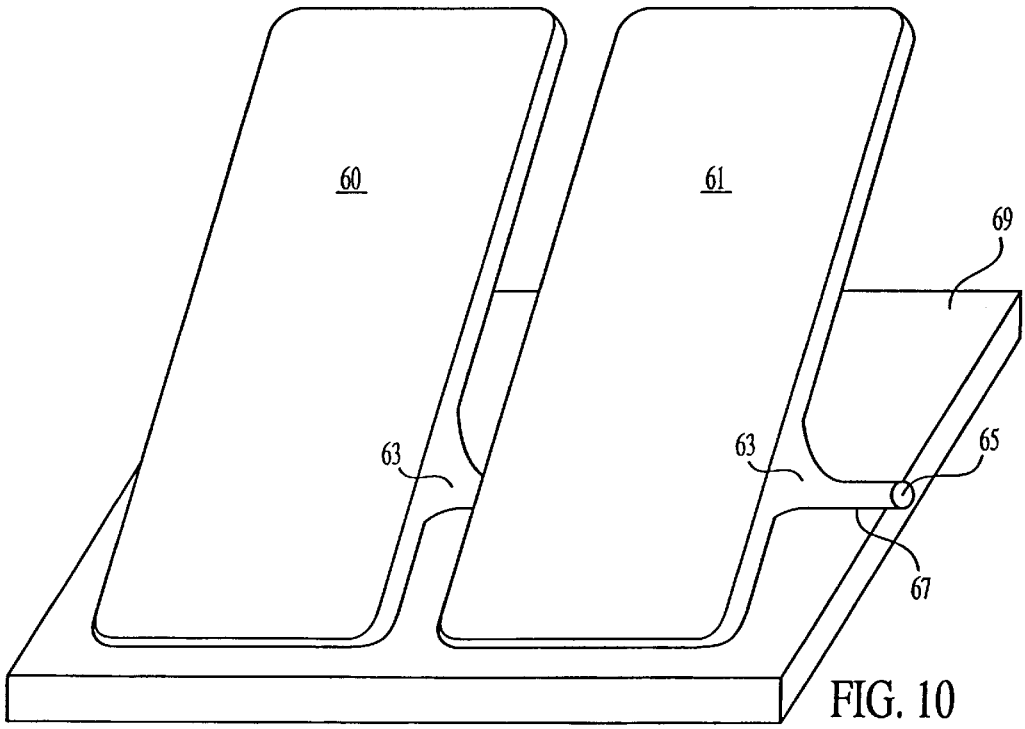
FIG. 10 is an isometric view of an alternative embodiment of the invention particularly adapted for construction of a plastic resin material in which the pivot point of the pedals has been moved farther from the surface of the pedal, in the case shown, essentially to the surface, or just below the surface, of the base.

Referring to FIG. 10, a pivot point for the pedals, in this case enumerated as pedals 59 and 61, is provided with a unitary pivoting arrangement in which there is no separate pivot rod. Instead, an extension 63 on the lower portion of pedals 59 and 61 include a cylindrical pivot support 65 which mates with a cylindrical pivot groove or channel 67. Pivot groove 67 is semicircular so that it partially encompasses pivot support 65 to prevent pivot support 65 from slipping out of pivot groove 67 in base 69. Base 69 may have a series of short, outward extensions 71 on the lower surface which provide roughness to such lower surface which will tend to interact with a heavy carpet or the like, and prevent base 69 from sliding along ground.

Figure 11:
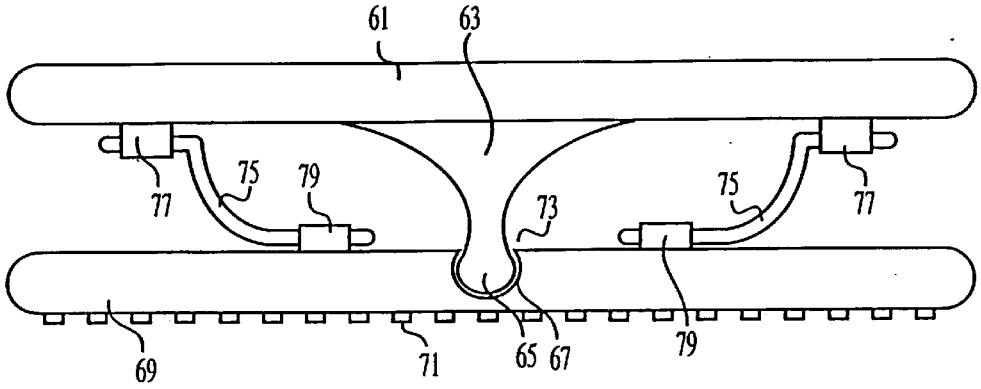
FIG. 11 is an enlarged side elevation of the embodiment of the invention shown in FIG. 10.

FIG. 11 is an enlarged side elevation of the arrangement shown in FIG. 10 in which pivot support 65 may be contained within pivot groove 67 in base 69. It will be noted that the upper portion or opening 73 along the top of pivot groove 67 is narrower than the extreme diameter of the pivot support 65 so that once the pivot support 65 is inserted into pivot groove 67, from the side of base 69, pivot support 65 cannot be withdrawn from pivot groove 67 except from the side of base 69. Pivot support 65 is held upon the end of extension 63, and the width of the extension along the top of pivot support 65 is such that a significant clearance is provided between the side of opening 73 and extension 63 so that extension 63 may be rocked from side to side without contacting the edges of opening 73. This allows pedal 61, which is mounted upon the upper portion of extension 63, to rock from side to side in accordance with pressure placed upon its surface by the feet of the user. Flexible spring strips 75 are secured to pedal 61 by fastening loop 77 to the top of base 69 by a similar fastening loop 79. The flexible strips hold the underside of pedal 61 away from the upper side of base 69. Flexible strips 75 may be formed from any of the well known spring materials. Flexible strips 75 serve as an effective rocking resistance medium for exercise device 10.

Exercise device 10 is structurally arranged such that a force must be applied to the surface of pedals 59 and 61 to cause them to rock so that first one and then the other end approaches the surface of base 69. As noted before, the bottom of base 69 is provided with light extensions of the surface which serve to roughen the surface and provide additional gripping with whatever surface the bottom of base 69 is set upon. A square or even circular pattern of slight extensions may also be very effective when placed upon a pile rug to prevent slippage of base 69. If base 11 is to be placed upon a wooden floor, it is desirable to provide rubber extensions or even metal extensions having points upon the ends to obtain a better grip. Since the feet of the user are actually placed on top of the pedals and then the feet rocked to obtain the exercise inherent in operation of the device, there is less tendency for base 11 to slide upon the ground.

Figure 12:
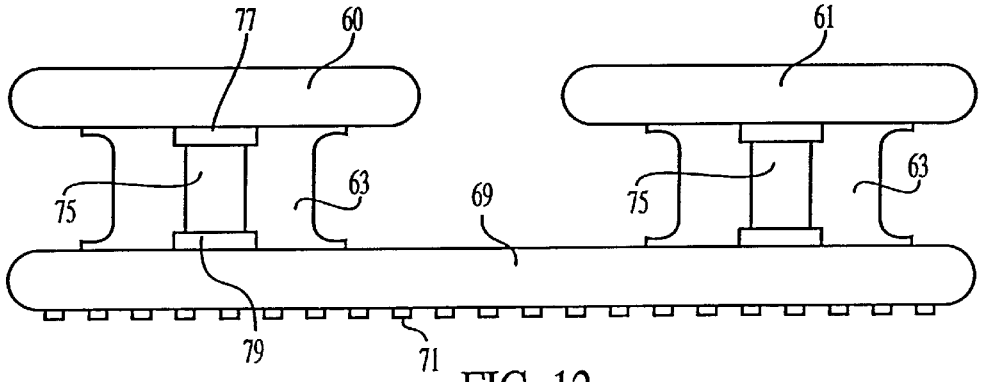
FIG. 12 is an end view of the embodiment of the invention shown in FIGS. 10 and 11 which alternative embodiment may also be formed from a plastic resin material.

Referring to FIG. 12 extension 63 on the bottoms of both pedals 59 and 61, along with the spring strips 75, serve to provide resilient resistance against rocking of pedals 59 and 61. The apparatus shown in FIGS. 10–13 is particularly adaptable for molding from a plastic resin composition, while the apparatus shown in FIGS. 1 through 9 is particularly adaptable for construction from metal, wood, hardboard and the like.

Figure 13:
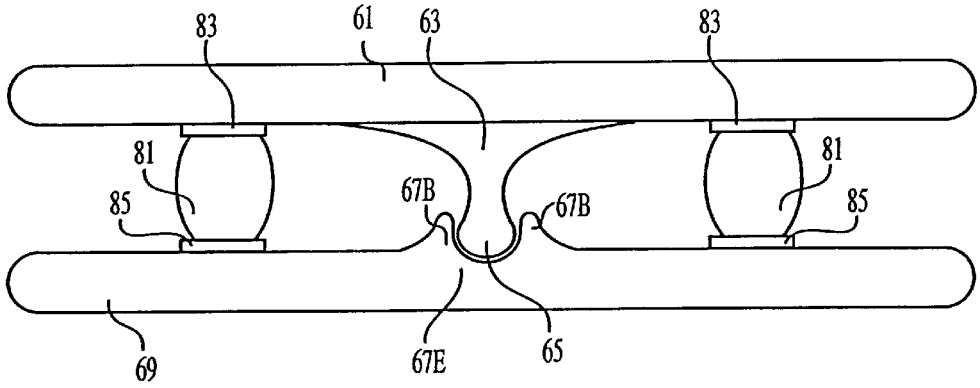
FIG. 13 is an enlarged side elevation of an alternative version or embodiment of the displaced pivot version of the invention shown in FIGS. 10 through 12, which alternative embodiment may also be formed from a plastic resin material.

Referring to FIG. 13, a similar rocking arrangement is provided as in FIGS. 10 through 12, with pivot support 65 journaled within a pivot groove 67. In this case, rather than being an actual groove in the base, pivot groove 67A comprises overlapping portions 67*b* which together form enclosed groove 67*a* in which pivot support 65 is journaled. As may be seen in FIG. 13, pivot support 65 may be slid into the pivot groove 67A from the side of base 11. However, in this embodiment, groove 67 is partially embedded in base 69 and partially secured upon the surface of base 69. In this way, the pivot point of pedal 61 is moved closer to the pedal. The resilient means which tend to keep the pedal from approaching the surface of base 69 comprise resilient elastic members such as rubber sections 81 which are held at both ends in mounting rings 83 and 85, respectively, on the surface of the pedal and the surface of the base. Such resilient members 81 may, for example, be in the form of somewhat egg-shaped sections of natural or synthetic rubber or may be inflated egg-shaped sections or may take several other forms of polymeric substance serving as a resistance means to discourage close approach between the lower surface of the pedal and the upper surface of the base.

Figure 14:
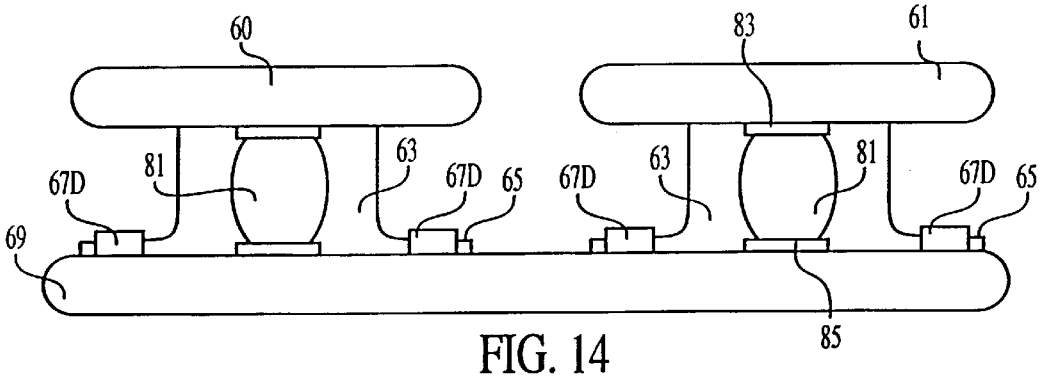
FIG. 14 is an end view of the alternative embodiment of the invention shown in FIG. 13.

Referring to FIG. 14, extension 63 will be seen to extend upwardly to the bottom of pedals 59 and 61 only in the center of these pedals and the enclosing members 67*b* only extend over pivot supports 65 at the ends of the pivot supports, away from the extensions, so that the enclosing members 67*b* can fit more closely about the top of pivot support 65 without preventing pivoting of pedals 59 or 61. In such an arrangement, the pedals 59 and 61 will still pivot, since upon pivoting to either side, the extensions 63, which are spaced between the enclosing members 67*a*, pass downwardly about the members at a different point and there is no interference between the rocking of the pedals 59 and 61 and contact of the extensions 63 with the top of the enclosing members 67*b*.

Figure 15:
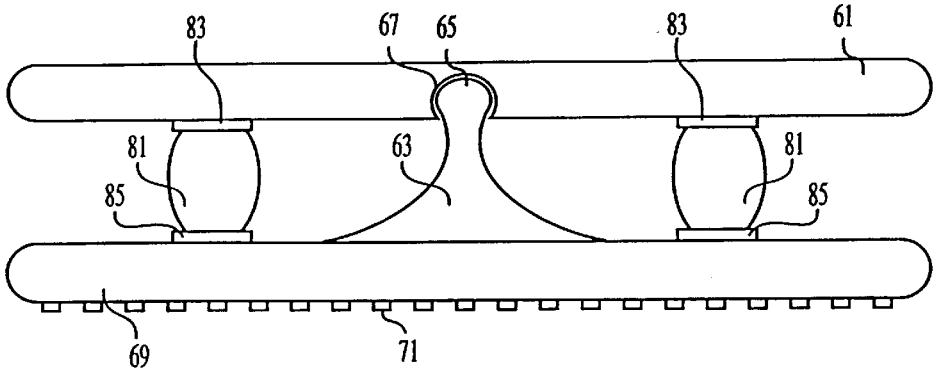
FIG. 15 is an enlarged side elevation of a still further embodiment of the invention in which the pivot point of the pedals is within the structure of the pedals themselves, which embodiment may also be readily formed of a plastic resin material.

Referring to FIG. 15, an alternative embodiment is disclosed in which pivot support 65 is supported on extension 63 and embedded within the pedal structure 61 rather than within the structure of base 69. In other words, pivot support 65 is supported directly upon base 69 by extension 63 and pedal 61 is fitted over pivot support 65 in a pivot groove 67. The same arrangement of resilient members which resist pivoting of pedal 61 with respect to base 69 is shown in FIG. 15 is as shown in FIGS. 13 and 14. It will be noted that the pivot support which defines the pivot point of each pedal is mounted near the rear of the central portion of the pedal. In one embodiment, the pivot point is positioned at about ¼ to ½ the length of the pedal, as measured from an end. If such position of the pivot point of the pedal is used, the user will obtain the gentle, soothing rocking motion desired in the apparatus. Moving the pivot point well beyond the central portions will tend to unbalance the entire apparatus and to prevent the soothing rocking motion which has been found to be particularly appropriate for the treatment of injuries to the lower extremities.

Figure 16:
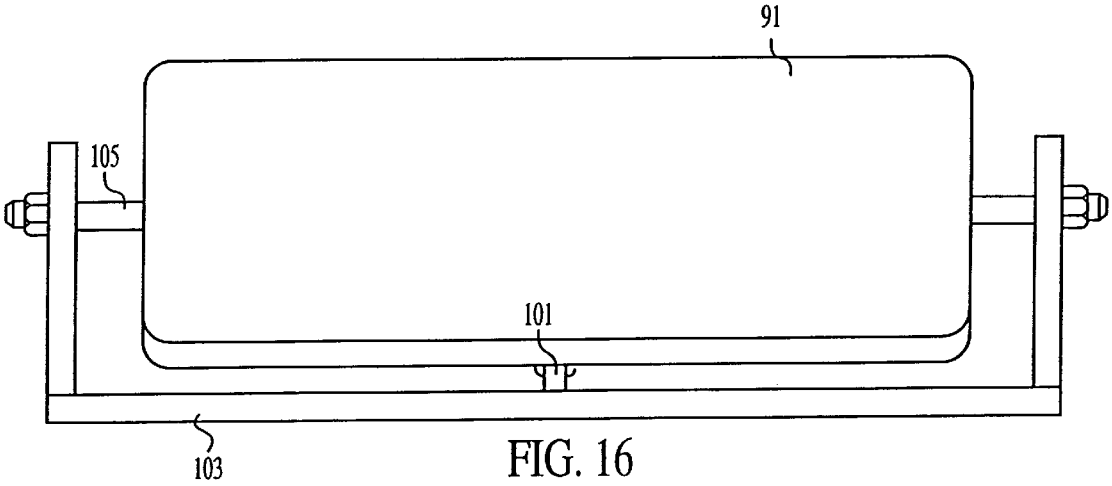
FIG. 16 is an end view of a single pedal embodiment of the invention with an alternative arrangement for providing resilience to movement of the pedal.
Figure 17:
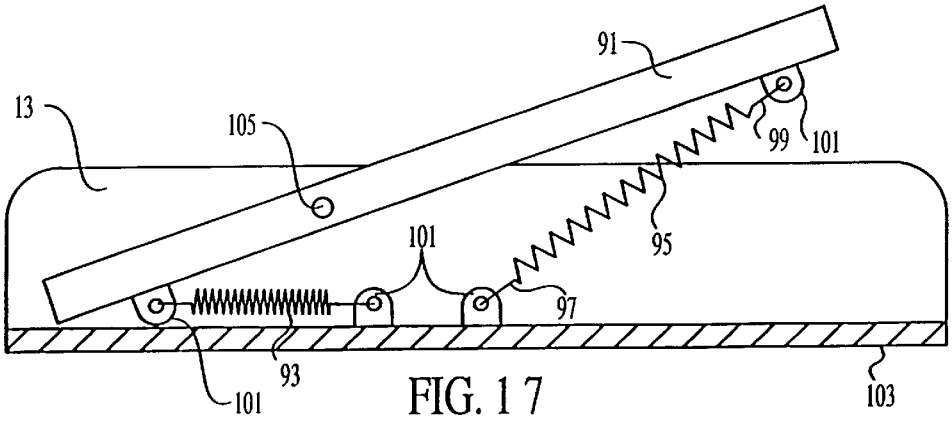
FIG. 17 is a partially broken away side elevation of the embodiment shown in FIG. 16.

Referring to FIGS. 16 and 17, a further version of the invention is disclosed in which there is only a single pedal 91 having a width sufficient to accommodate a pair of feet. At least one resilient spring 93 provides tension to pedal 91. In such an arrangement, springs 93 and 95 are attached by bar extensions 97 and 99 to the outer lower portions of pedal 91 as well as to short posts or bollards 101 mounted upon base 103 near the center of exercise device 10. As pedal 91 is rocked on its pivot rod 105, one or the other of springs 93 or 95 are extended. In this particular embodiment the pivot rod 105 passes either directly through the center of pedal 91 or via a joint (bearing) attached to the bottom of the pedal. The arrangement and size of the springs 93 and 95 shown in FIG. 17 has the advantage of providing a fairly soft rocking movement of the pedal due to the longer tension springs.

Referring to FIGS. 18 and 19, a two pedal version of the apparatus of the invention is disclosed, in which two fluid cylinders 107 and 109 are substituted, on two separate pedals 91*a* and 91*b*, for the springs 93 and 95. One end of fluid cylinders 107 and 109 is also attached, via extension bars 97*a* and 97*b*, to transverse attachment bar 111 which extends between elevated support pedestals 113 and 115, into which pivot rod 105 is also journaled. The remainder of the reference numerals in FIGS. 18 and 19 refer to similar structures as shown in FIGS. 16 and 17 when referring to similar structures. The use of the support pedestals 113 and 115 rather than side walls 13 and 15 shown in previous figures has the advantage of providing a more open structure, but requires a sturdier construction to securely support pivot rod 105. The advantage of the arrangement of the fluid cylinders shown in FIGS. 18 and 19 is that a larger travel of the piston in the cylinder is available and the general feel of the resistance will consequently be somewhat different from the analogous use or arrangement of fluid cylinders shown in FIG. 5.

Figure 21A:
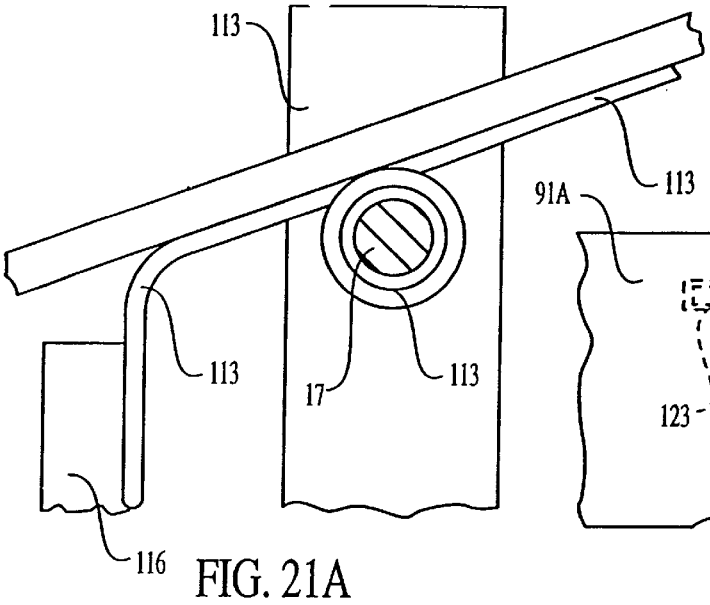
FIG. 21A is an enlarged detail of the mechanical arrangement of the spring assembly of the embodiment of the invention shown in FIGS. 20 and 21.

Referring to FIGS. 20 and 21, a further embodiment of the invention is disclosed in which two pedals are shown mounted upon a pivot rod 17, as shown in FIGS. 1 through 4. Pivot rod 17 is mounted upon the underside of two pedals 19A and 19B. The remainder of the arrangement is essentially the same as is shown in FIGS. 1 through 4, except that pivot rod 17 is mounted in pedestals 113 and 115. A different arrangement of spring biasing means is used in this embodiment, in the form of coil springs 113 and 113*a* which are coiled about pivot rod 17, and caught behind support structures 115 and 115*a*. When pedals 19 and 21 are depressed either forwardly or rearwardly, springs 113 and 113*a* will either be compressed or allowed to extend, thus providing resistance against depression of the pedal on either end. An enlarged and simplified detail of the spring arrangement is shown in FIG. 21 A with nonessential elements of the resilience impacting device deleted. Pivot rod 17 is mounted on the bottom of pedals 19 and 21 to provide a convenient spring mounting for this type of resistance spring arrangement.

Figure 22:
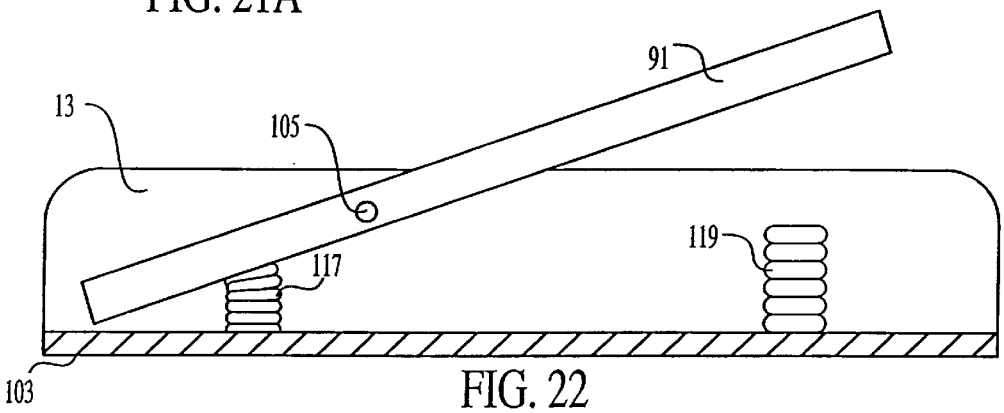
FIG. 22 is a partially broken-away, side elevation, of an alternative arrangement for providing resilience to the pedals of the exercising apparatus of the invention.

FIG. 22 shows a still further embodiment of the invention in which a pedal 19 having an internal pivot rod 105 (as in FIGS. 16 through 19) is used, but in which corrugated air or balloon-type spring resistance elements 117 and 119 are shown arranged to provide resistance to depression of one or the other end of the pedal 91.

Figure 23:
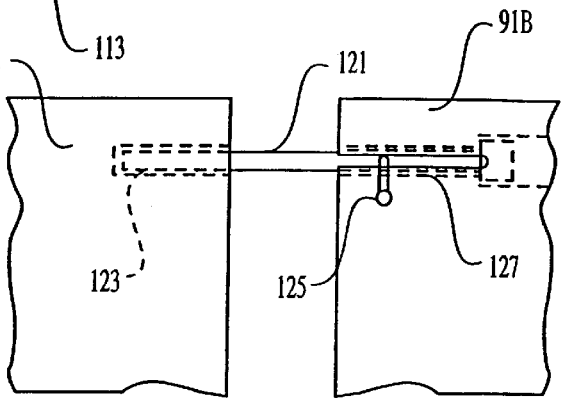
FIG. 23 is an enlarged detail of an alternative arrangement for locking together and coordinating the movement of two pedals of an exercising machine in accordance with the invention.

FIG. 23 is an enlarged view showing an improved internal latch arrangement in which a slide bolt 121 is slidingly mounted in a groove or cut out section of one pedal 91B opposite an orifice 123 in an adjacent pedal 91A. A handle 125 extends from a groove 127 over the bolt and allows bolt 121 to be slid either to connect the two pedals or to disconnect them.

Figure 24:
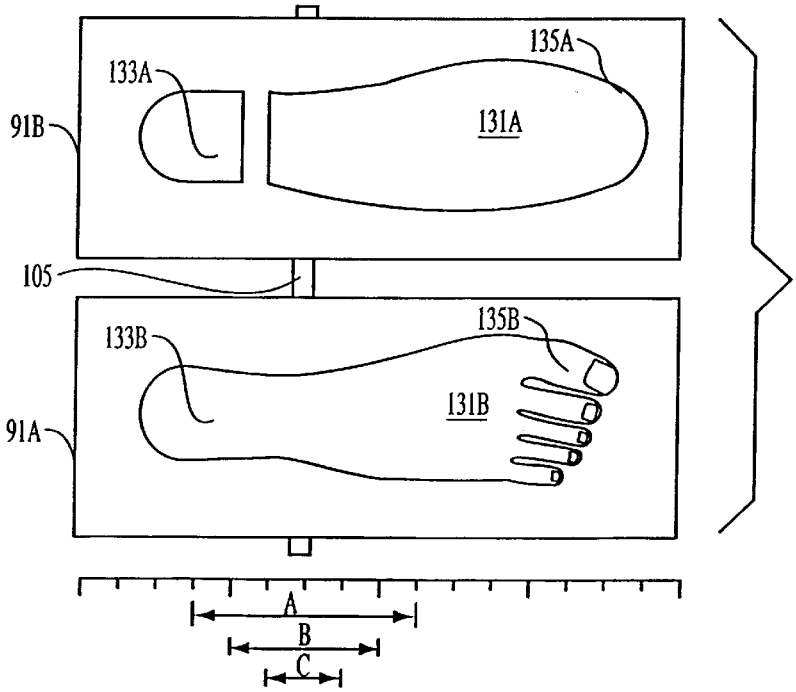
FIG. 24 is a plan view of two typical pedals in accordance with the invention showing the arrangement of the feet of a user upon the pedal and the preferred placement of the pivot point with respect to the feet and the pedal.

FIG. 24 is a diagrammatic plan view of the foot exerciser of the invention in which an actual outline of the feet of the user is shown on top of the pedals as a guide to the placement of the feet with a scale indication on the side of the relative distance of the pivot point from the defining point or heel of the arrangement as a guide. One of the outlines is shown as the sole of a shoe and one represents the sole of a barefoot. As indicated, the placement of the pivot of the pedals may be from 3/16 of the distance from the rear of the heel position of the pedal, to the front toe position on the pedal to 9/16 of the distance from the rear of the heel position to the front toe position on the pedal. More preferably, the pivot will be located between ¼ and ½ of the same distance, and most preferably the pivot will be located between 5/16 and 7/16 of the same distance. These three ranges are shown at the side of Figure or the bottom of the figure by side by side brackets marked "A" for the widest or broadest range, "B" for the still more preferable range and "C" for the most preferable range. It will be noted that the actual pivot point in FIG. 24 is within each of these ranges. The heel of both foot patterns 131A and 131B in FIG. 24 are designated as 133A and 133B, and the front of the foot patterns are designated as 135A and 135B.

Normally the user of exercise device 10 will place its feet upon the pedal, after a little practice or experience, in the most comfortable position with respect to the pivot point to obtain a comfortable rocking position. This will be found to conform with the range of positions enumerated hereinabove. If the pedal is longer than the foot and the pivot position is measured with an equal amount of pedal extension on both ends of the foot the proper placement of the pivot point will be maintained. In other words, if a foot of any reasonable length is imagined placed centrally upon the pedal and the pivot point is determined as set forth above, approximately the correct position will be attained. Furthermore, if the pedal is approximately the same length as the foot the distances can be measured from the rear of the pedal. Of course, a custom positioning can also be made for any particular user by finding the length of their foot, laying out such length on the surface of the pedal and then arranging the pivot point within the ranges specified.

It will be understood that the apparatus of the invention may be formed of various materials, depending on the particular design. For example, as indicated above, the embodiments of the invention shown in FIGS. 1 through 9 may be readily made of metal, or in some cases, even of wood and various grades of plastic. Those embodiments shown, however, in FIGS. 10 through 15, will generally be more adaptable to formation out of various types of structural-type plastic material. Combinations of materials may also be used.

In general, in the use of the apparatus shown in the foregoing drawings and figures, the feet of the exerciser are placed upon or against a contact and rocking surface which is arranged to be pivotable upon some form of pivot support or other apparatus or arrangement providing a comparable movement when pressed upon by the feet of the user. The user then alternately depresses, or presses downwardly, with the rear or heel portion of his or her feet and downwardly with the forward or toe portion of their feet. Pressing downwardly with the heels while raising the toes, if persisted in until the feet and ankles feel stretched or mildly stressed, will be found to be relaxing to the lower legs not only to one whose normal movement has been restricted by injury, but also to those merely spending a large amount of time in a seated position such as on the job or watching television or the like. When the forward or toe portion of the foot is pressed downwardly, on the other hand, the relatively large calf muscles as well as other muscles in the leg and feet participate in moving the foot aiding in particular, as explained above, in the movement of blood through and away from the legs thus avoiding stasis or pooling of the blood as well as contributing to both the tone of the muscles and a feeling of well being of the one making the movement. The more resistance offered particularly to depressing of the forward position of the exercising apparatus, normally the forward portion of a pedal of the exercise apparatus, the more exercise will be had by the participant. The advantage, in particular, of being able to rock the feet backward as well as merely forward as is more usual in other already available apparatus, is that rearward movement or rocking movement of the foot actively stretches and relaxes the muscles and ligaments in the leg before again stressing them in moving the foot in the opposite direction to contract the calf muscles. In addition, of course, there is also active exercising of the relatively small muscles in the lower legs which actively raise the forward portion of the foot relative to the leg, which muscles are seldom exercised or toned, except by some rather specialized weight-type exercise apparatus found usually only in certain commercial health-type exercise centers.

In practicing the method of the invention, therefore, the user of the apparatus of the invention or any other apparatus providing or allowing a similar movement will alternatively rock their foot against the apparatus, first raising the toe and pressing down the heel, and then raising the heel and pressing down the toes, or vice versa, in usually any rhythm that is comfortable to the exerciser. While it is true that anyone can do the same thing by extending their leg and alternately rocking the feet up and down even without an apparatus against which to rest or press the feet, the effect is completely different. In the first place, movements accomplished without any coordinating apparatus tends to become uncoordinated. In the second place, to properly make the movement, the feet will usually have to be raised from the floor, which position cannot be held for more than a short time by the usual individual. In the third placed, the foot usually operates while in contact with a surface, except while changing feet or stepping when either walking or running. As a result, the feet simply feel better when exercising, if they are placed in contact with a surface. Furthermore, without a suitable apparatus it is not possible to conveniently apply any contra or reverse pressure against the movement of the foot, particularly when seated. Thus it is only with a suitable apparatus that any real contra resistance to the movements of the foot can be obtained. However, as indicated, there are a number of possible variations of apparatus of which the Applicant's claimed apparatus is particularly suitable.

Figure 25A:
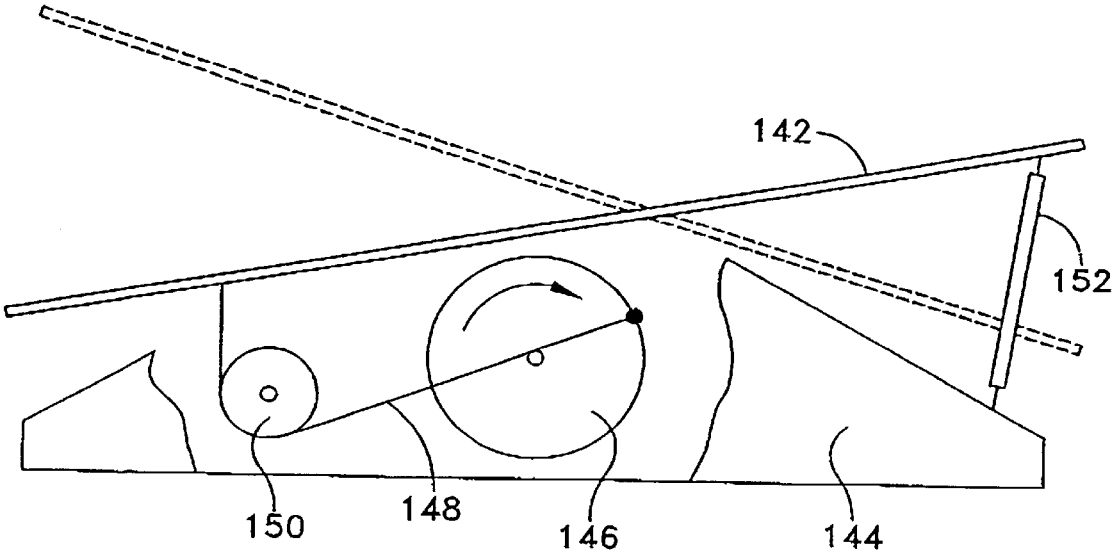
FIG. 25*a* is a side elevation view of another embodiment of the invention showing an alternative arrangement for a single pedal embodiment wherein a driving wheel, pulley and resilient means are used to generate a rocking motion of the pedal and the resilient means is in an extended position.
Figure 25B:
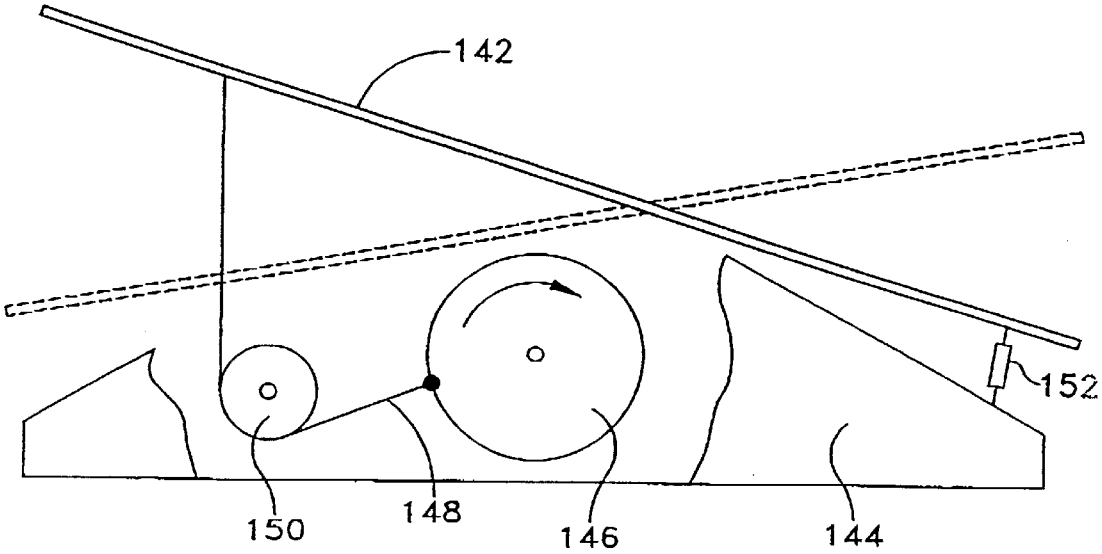
FIG. 25*b* is a side elevation view of the embodiment of the invention shown in FIG. 25*a* with the resilient means in a contracted position.

FIGS. 25*a* and 25*b* show a further embodiment of the invention in which there is only a single pedal 142 having a width sufficient to accommodate a pair of feet. The pedal 142 is pivotally connected to a base 144. A means for generating pivotal movement of the pedal is further provided and includes a drive wheel 146 mounted to the output shaft of an electric motor (not shown). A pulling line 148 is connected between the drive wheel 146 and the pedal 142 whereby each rotation of the drive wheel 146 produces a reciprocating motion of the pulling line 148. In the embodiment shown, the pulling line 148 rides on a pulley wheel 150 which is journaled to base 144. The pulley wheel redirects the orientation and force generated through the pulling line to provide for a full range of motion of the pivoting pedal for each revolution of driving wheel while maintaining a compact design of the apparatus. A resilient member 152 such as a coil spring, for example, is connected between the pedal 142 and the base 144 and provides an opposing force to the reciprocating pulling line to maintain tension in the pulling line and return the pedal to its starting position as the driving wheel completes each revolution.

Figure 26A:
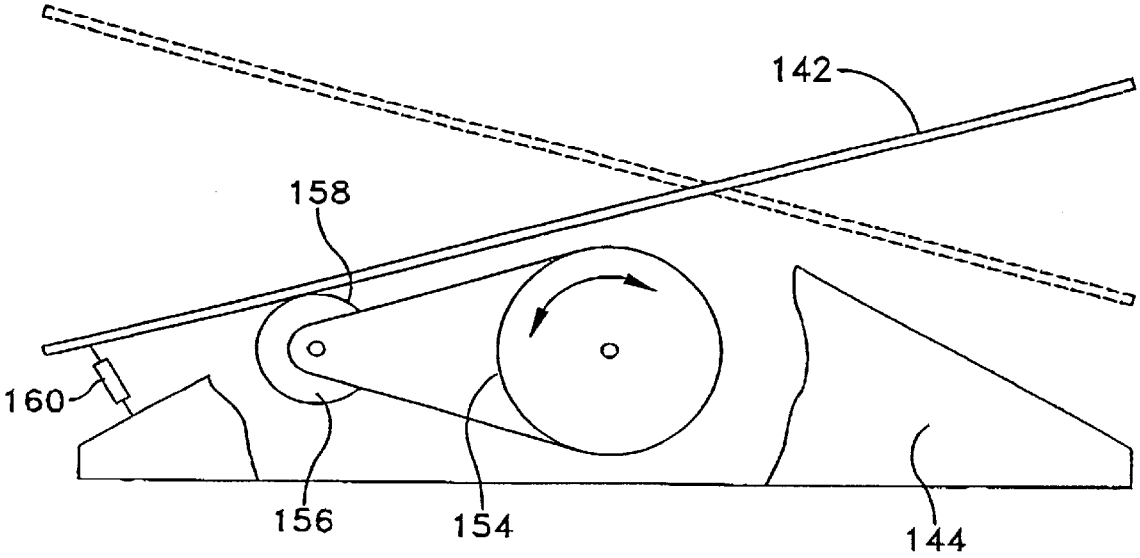
FIG. 26*a* is a side elevation view of another embodiment of the invention showing an alternative arrangement for a single pedal embodiment wherein an actuator and sliding wheel, and resilient means are used to generate a rocking motion of the pedal and the resilient means is in a contracted position.
Figure 26B:
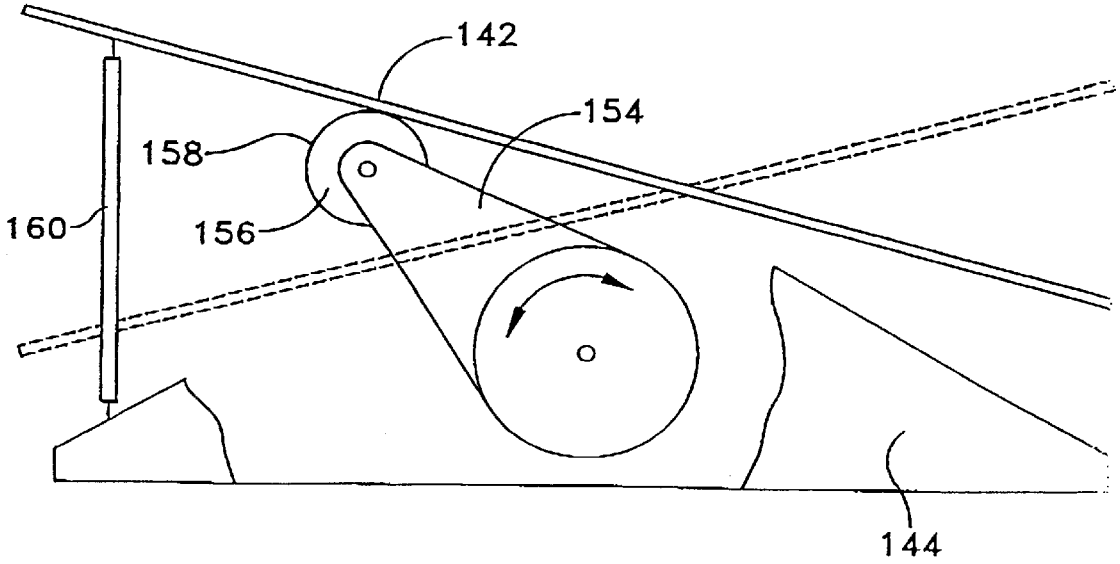
FIG. 26*b* is a side elevation view of the embodiment shown in FIG. 26*a* with the resilient means shown in an extended position.

FIGS. 26*a* and 26*b* show a further embodiment of the invention incorporating a single pedal design in which a means for generating pivotal motion of the pedal 142 comprises a pivot arm 154 which is mounted at one end to an actuator (not shown). It is contemplated that numerous known actuator devices including electrical, hydraulic and pneumatic actuators may be used in accordance with the present invention. A sliding wheel 112 is journaled to the opposite end of the pivot arm 154 and has a circumferential edge 158 which rides on the surface of pedal 142. Operation of the actuator imparts an oscillating motion to the pivot arm 154 causing the sliding wheel 156 to roll across the surface of the pedal 142, vertically displacing the contacted end of the pedal 142 and pivoting the pedal about its pivotal axis. A resilient member 160 such as a coil spring, for example, is connected between the pedal 142 and the base 144 and provides an opposing force to the force of sliding wheel 156 against pedal 142 such that when the direction of the pivot arm 154 and sliding wheel 156 reverses through each cycle, the opposing spring force returns the pedal 142 to its starting position.

Figure 27A:
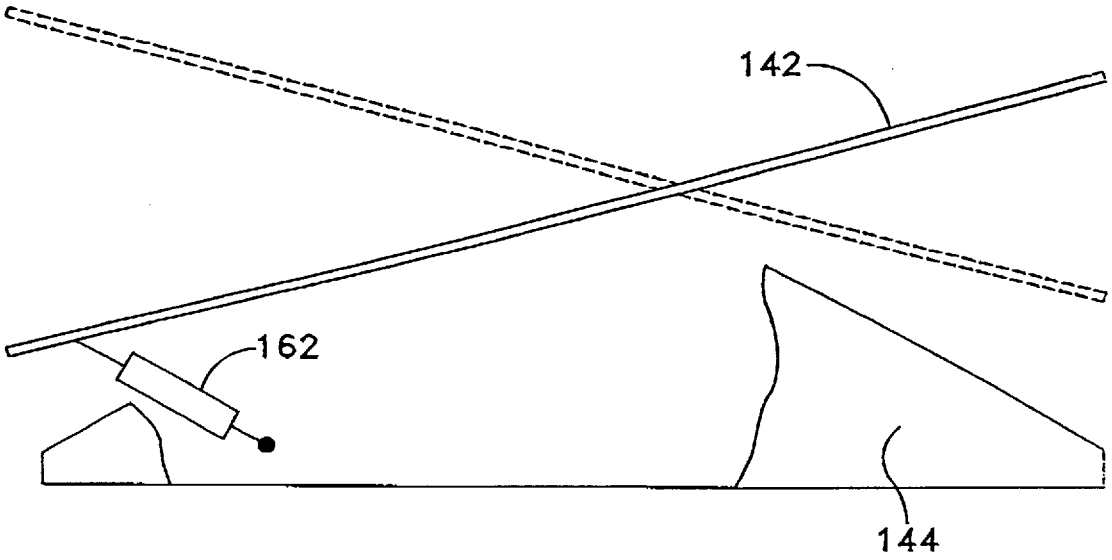
FIG. 27*a* is a side elevation view of another embodiment of the invention wherein a solenoid is used to generate a rocking motion of the pedal and the solenoid is in a contracted position.
Figure 27B:
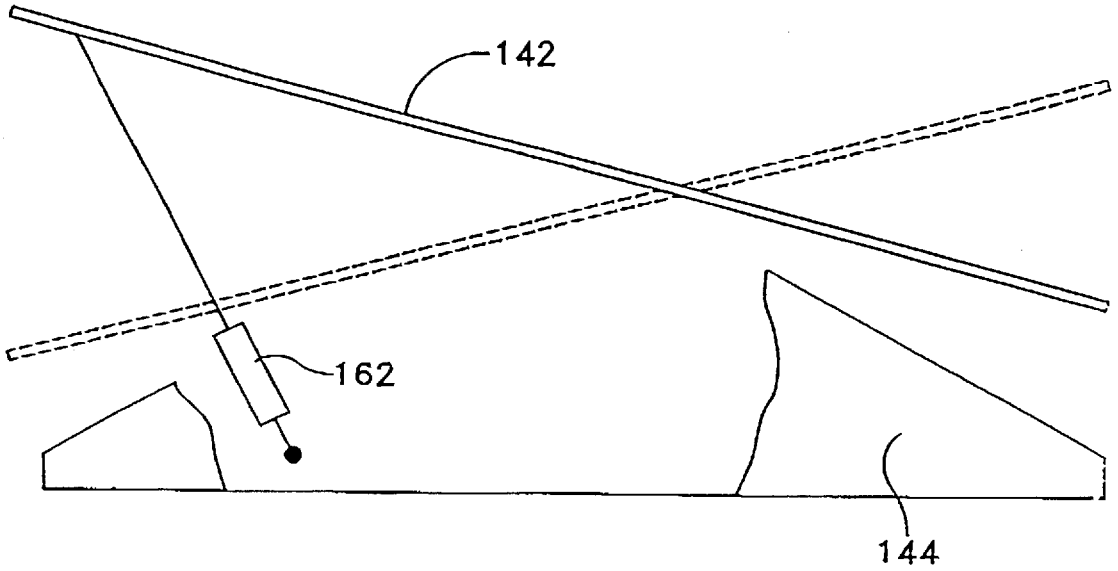
FIG. 27*b* is a side elevation view of the embodiment shown in FIG. 27*a* with the solenoid shown in an extended position.

FIGS. 27*a* and 27*b* show a further embodiment of the invention having a single pedal design wherein a solenoid is used to generate pivotal motion of the pedal 142. The solenoid 162 is connected between the pedal 142 and base 144 and may be selectively positioned on either side of the pivotal axis of pedal 142, to alternately push or pull, to generate a rocking-type motion of the pedal 142.

Figure 28:
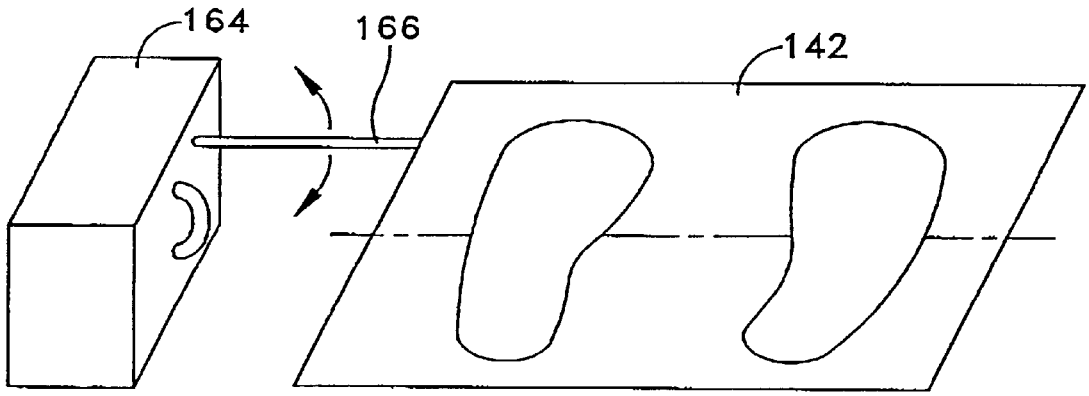
FIG. 28 is a perspective view of another embodiment of the invention showing a motor/actuator positioned beside the platform used to generate a rocking motion of the pedal.

While the aforementioned embodiments of the invention are particularly adapted to providing a compact design wherein the various mechanisms for facilitating rocking-type motion are disposed beneath the foot pedals, it is also contemplated that a mechanism for producing a rocking-type motion of a foot pedal may be positioned alongside or above the foot pedals. FIG. 28 shows a further embodiment of the invention wherein a motor/actuator 164 is positioned beside a pedal 142. A connecting arm 166 extends between the motor/actuator and pedal whereby activation of the motor/actuator causes a reciprocating motion of the connecting arm 166, which in turn generates a rocking-type motion of the pedal 142.

While the present invention has been described at some length and with some particularity with respect to several described embodiments, it is not intended that it should be limited to any such particulars or embodiments or the particular embodiment, but is to be construed broadly with reference to the appended claims so as to provide the broadest possible interpretation of such claims in view of the prior art and, therefore, to effectively encompass the intended scope of the invention.

What is claimed is:

1. A lower extremity exercise apparatus adapted for facilitating movement of the feet and lower legs of a seated person comprising:

(a) a base;

(b) at least one foot contact and support means having a length and a width sufficient to make contact with at least the major portions of the sole of at least two human feet, the support means having a heel position, a toe position, and ball of the foot position;

(c) the foot contact and support means being pivotally connected to the base for relative pivotal movement between the base and the foot contact and support means about a transverse pivotal axis;

(d) the pivotal axis being disposed longitudinally of the foot contact and support means approximately from three-sixteenths of the distance from an edge of one of the heel position and the toe position, respectively, to nine-sixteenths of the distance from an edge of one of the heel position and the toe position, on the foot contact;

(e) the pivotal axis of the foot contact and support means being disposed with respect to said contact and support means and base such that the angle of the foot contact and support means, when pivoted downwardly toward the base upon one end, will provide an angle of the foot contact and support means such that a seated person may comfortably rest their feet upon the upper surface of the foot contact and support means from an adjacent seated position and can move or rock the far end of the foot contact and support means downwardly with the forward portion of their foot by downward pressure from said forward portion of their foot;

(f) a means for generating pivotal movement of the foot contact and support means about the pivotal axis; and (g) a resilient means for generating a counter force towards the rocking motion wherein the means for generating pivotal movement of the foot contact and support means comprises a motor operatively coupled to the foot contact and support means.

2. A lower extremity exercise apparatus in accordance with claim 1 wherein the means for generating pivotal movement of the foot contact and support means further comprises:

a drive wheel mounted to said motor;

at least one pulley journaled to said base;

a pulling line having one end connected to said wheel and an opposite end connected to said foot contact and support means, said pulling line being partially disposed in a circumferential groove of said pulley; and a resilient means connecting between said foot contact and support means and said base;

wherein the operation of said motor imparts a rotation to said drive wheel which in turn generates a reciprocating motion of said pulling line causing said foot contact and support means to pivot about said pivotal axis, said resilient means providing an opposing force to said reciprocating pulling line to facilitate pivotal movement of said foot contact and support means.

* * * * *